US006017035A

United States Patent [19]

Glasser et al.

[11] Patent Number: 6,017,035

[45] Date of Patent: Jan. 25, 2000

[54] METHOD FOR PLAYING AN EDUCATIONAL GAME

[76] Inventors: Jerome Glasser, 16 Sunset Terrace Maplewood, Maplewood, N.J. 07040; Jared Phillips, 21 Woodmont Dr., Woodcliff Lake, N.J. 07675

[21] Appl. No.: 08/911,761

[22] Filed: Aug. 15, 1997

[51] Int. Cl.[7] ..... A63F 1/00

[52] U.S. Cl. ..... 273/308; 273/302; 273/299

[58] Field of Search ..... 273/308, 302, 273/299

[56] References Cited

U.S. PATENT DOCUMENTS 2,034,991 3/1936 Salinger ..... 273/308
2,177,078 10/1939 Raizen et al. ..... 273/249
5,226,665 7/1993 Huang ..... 273/295
5,472,207 12/1995 Sullivan, Jr. et al. ..... 273/249

OTHER PUBLICATIONS

"Screen Legends Playing Card Deck", U.S. Games Systems, Inc. catalog, p. 21, 1992.
"Six Degrees Of Kevin Bacon Game", received in the PTO Dec. 1, 1998.

*Primary Examiner*—Benjamin H. Layno

[57] ABSTRACT

An educational game, requiring for play at least one person and two separate sets of game information, challenges a player to connect the identity of actors via co-roles in motion pictures, or to connect motion pictures via the identity of at least one actor who had a role in each, with information sets appearing randomly so that successful play depends on luck as well as a player's knowledge.

7 Claims, 4 Drawing Sheets

METHOD FOR PLAYING AN EDUCATIONAL GAME

FIELD OF THE INVENTION

The present invention pertains to games and/or puzzles that in order to successfully be played depend on players' abilities to use their personal knowledge to combine into sets visual images displayed on game pieces.

DESCRIPTION OF THE PRIOR ART

Games such as trivia-style games that call upon a player's knowledge of information that is not primarily derived from the game itself, are known in the prior art. Games such as traditional playing-card style visual image games that challenge a player to form sets of cards, are also well-known in the prior art. Prior art trivia games depend on questions that are presented in block text format. They do not use visual images in game play. Nor does any trivia game require the creation of sets either of questions, or of answers in order for the game to be played.

Perhaps the most famous and commercially successful trivia game to date is Trivial Pursuits™. This trivia game depends on questions presented in text format printed on cards. Players call upon their individual, respective stores of general knowledge in order to respond to the questions posed on the cards. The simple object of the game is to score points by offering responses that substantially coincide with the answers provided by the game.

To play Trivial Pursuits™ successfully, there is no requirement that individual questions be in any way related to one another or that the responses to questions, whether correct or incorrect, be in any way related to one another. This is to say that there is no "linking" of the cards either visually or via questions or answers in order to achieve game play. Game play certainly in no way depends on the linking of any of the questions or answers in a sequential manner.

Successful play depends upon players' attempts to answer questions that one living in North America and exposed to North American culture and entertainment should have the capability to answer. The average North American game player, if he or she couldn't respond correctly to a trivia question at least would likely understand the cultural framework within which the question is posed. A fluent English speaker from China only recently arrived in North America and unfamiliar with North American culture, however, would not likely be able even to participate successfully in play as a result of his or her lack of knowledge regarding the cultural sphere through which the questioned have their frame of reference. While it would be possible, in theory, for such a player to studiously memorize the answer to every question through rote memorization, this exercise borders on "cheating" within the parameters of the game and, further, destroys the intended purpose of the game—that being to provide an enjoyable outlet for amusement and not a forum to demonstrate one's capacity for memorization. A game is supposed to be fun, not homework. A game should be playable without tremendous study, otherwise it borders on no longer being a "game", but rather a "sport". For a game that test knowledge, moreover, it is obvious that players need to be afforded the opportunity to check or challenge the correctness of player responses. In so doing, players are forced to actually demonstrate a proven knowledge of information and not merely a capacity for guesswork. Otherwise, a game becomes one of guessing and bluffing, and not one of a combination of luck, strategy and knowledge.

Contrary to trivia style games are those which depend essentially upon visual images in order for play to be accomplished. A commercially successful example of this, the game Waterworks™, requires no general knowledge by the players outside the basic game rules presented in the game directions. Once players learn the rules of the game itself, no external knowledge & expertise (i.e. cultural/social knowledge) is needed for players to easily and successfully accomplish play. There are no trivia questions and, for example, a non-American without an in-depth knowledge of North American culture and cultural icons yet familiar with the game rules could still successfully be incorporated into game play. This is not the case with trivia games such as Trivial Pursuits™ with which it would be difficult, if not impossible, for a person unfamiliar with North American culture to be incorporated into game play. Neither Trivial Pursuits™ nor any other trivia game incorporates visual images into cardplay that depends upon the establishment of card sets (i.e. the sequential linking of cards in predetermined manners) based on information gleaned from outside the game itself.

No closer relationship or relation of other prior art to the present invention is evident.

BACKGROUND OF THE INVENTION

It is undeniable that members of the American public both young and old love to play games. In fact, people of all cultures all over the world, love to play games! The toy and game industry reaps billions of dollars in profits annually in the United States alone. Card games are numerous within the game field since they are easy and inexpensive to manufacture. Card games that depend upon visual images to accomplish play are perhaps most numerous. However, trivia games which depend upon a player's knowledge of information not derived from within the game itself also exist. However, there has never before been a game that relies upon a player's sequential linking of images on cards or tokens through his or her own knowledge gained from outside the sphere of the game itself.

The American public loves to watch motion pictures. Much in the way the Royal Family is adored in Great Britain, famous motion-picture actors and actresses of the big silver screen are revered in the United States and may easily be considered America's "Royals". Printed magazines and TV Magazine-shows, although already numerous, nevertheless still do not seem to be able to satisfy the public's interest in the lives—both public and private—of America's movie stars. One restaurant chain, particularly, Planet Hollywood, has experienced tremendous international success by capitalizing on this insatiable hunger that the world has for virtually anything that is "Star" related.

Yet, there has never, heretofore, been any game that depends upon players' linking of visual images, such as images of movie stars, based on their knowledge of information developed outside the information presented inside the game. A game which calls upon players to link visual images of persons well-known in America and/or the world in certain pre-determined ways is new and novel. Although the commercial value of the likenesses of celebrities has been well-known for many years, as evidenced by the constant growth of the licensing industry, no game involving the images of celebrities on game pieces has heretofore been developed to capitalize on the images of the famous. Thus, there can be no doubt that such a game is not obvious.

SUMMARY OF THE INVENTION

The present invention relates to a game that requires the active participation of at least one player and includes at least two but preferably between 50 and 100 game pieces such as cards having upon them game indicia which may include but not be limited to images of people famous preferably in the U.S.A. but not limited thereto and preferably from the entertainment industries which include movies, music and sports.

It is a principal feature of the present invention to provide a game in which at least one player uses his or her specific knowledge of a certain topic, such as movie trivia to link together images representing well-known cultural icons in factually correct sets. The object of the game is to sequentially link together individual game pieces, preferably cards, in such a way that a set is formed. This can be difficult to achieve since, when play commences, there are many possible matches and a player must strategically determine what his or her chances are to successfully create a potential set.

Unlike traditional card games whose rules and card numbers are fixed and unvarying, another principal feature of the present invention is to provide a game whose game pieces may constantly be able to accept additional new game pieces in order to maintain the "freshness" and up-to-date quality of the game.

Yet another principal feature of the present invention is to provide a game whose enjoyment is derived from the strategic attempt to determine which game pieces to keep and which to discard in an effort to achieve the greatest possible chance to establish a set. As some game pieces more than others will have greater potential for making links, part of the strategy involves the decision making process of determining when to hold onto a game piece with great matching potential and when to discard one such card in favor of hopefully picking up one or another specific card that will complete a set. Unlike traditional card games, however, a person's ability to determine which cards have great potential for creating sets is entirely dependent upon a player's knowledge of information leaned not from statistics learned within the game, but rather through his or her knowledge of information about the field in which the visual images are part (i.e. rock music/classical music/art/sports/motion pictures, etc.).

It is another feature of the present invention to provide an inexpensive promotional advertisement for individual cultural icons that have a significance for the American public.

It is still another yet further feature of the present invention to provide a game which is capable of being easily transported by being slipped into a carrying bag, or shirt or suit jacket pocket.

Figure 1:
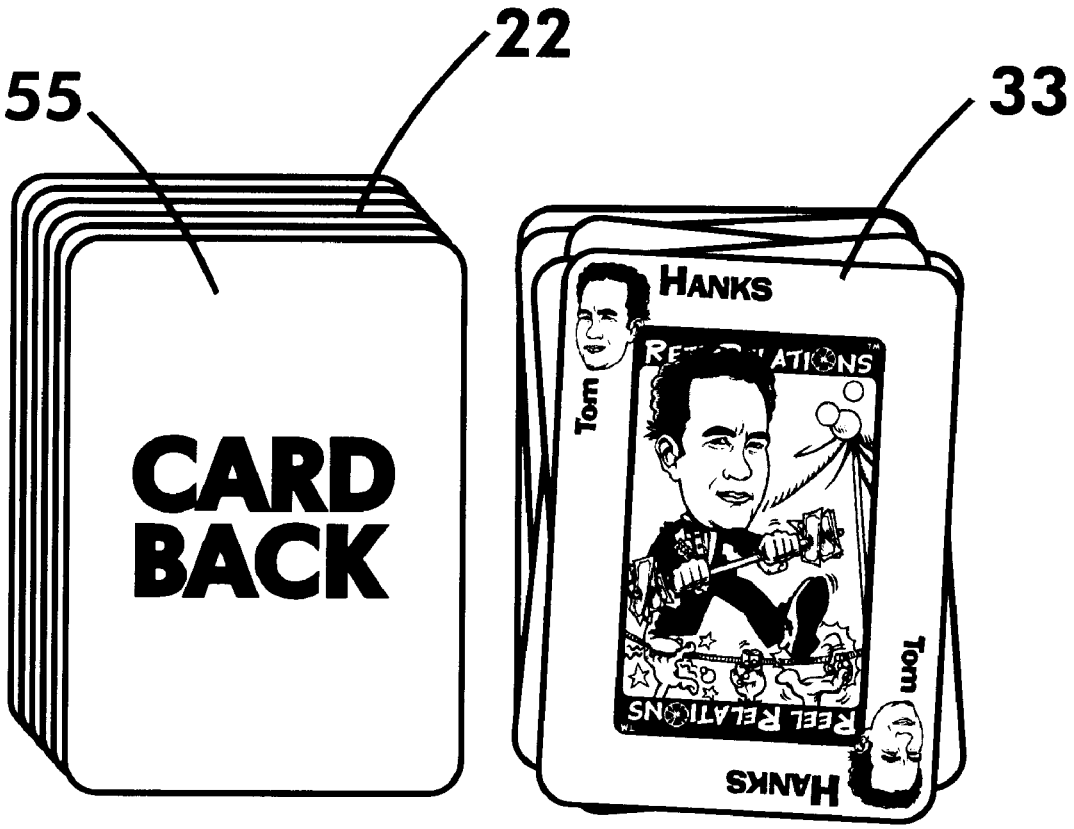
FIG. 1 shows an overview of the draw pile 55 of cards 22 face down ready to be picked-up and to its right, the discard pile 33 of cards face up.
Figure 2:
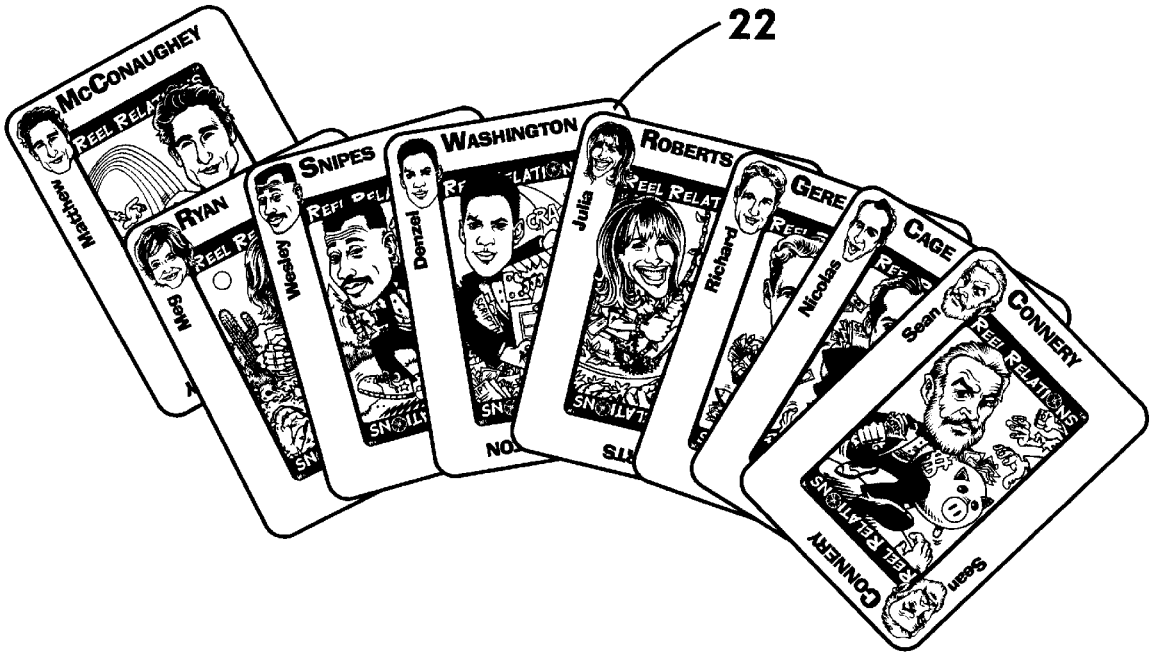
FIG. 2 shows a full hand of seven cards having an incomplete set (not all seven cards link sequentially) and one card ready to be discarded in exchange for the last discarded card which can be viewed in its face up position on the discard pile 33 in FIG. 1.
Figure 2:
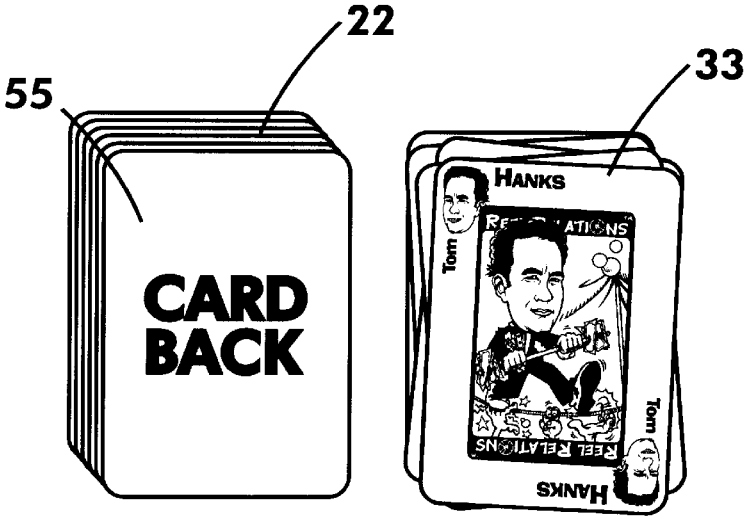
Figure 3:
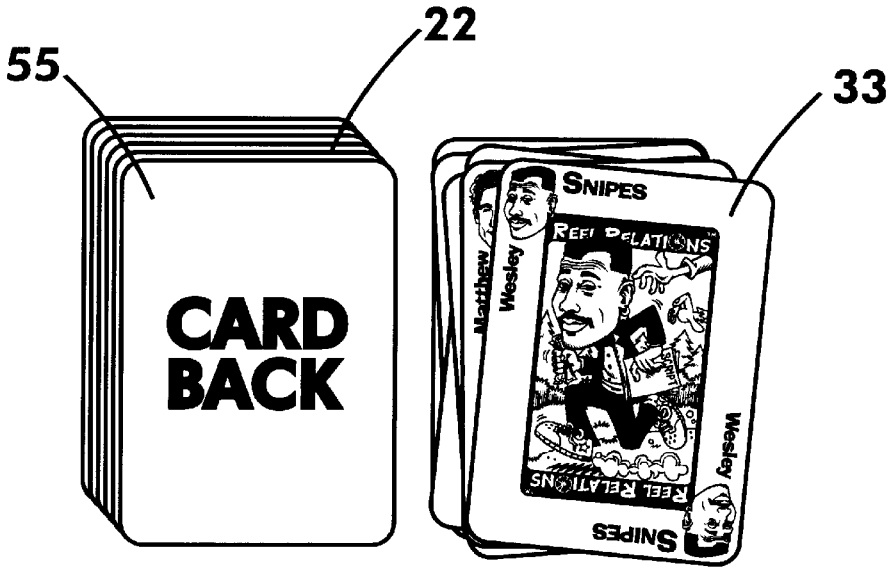
FIG. 3 shows an overview of a pile of cards face down ready to be picked-up and to its right, the discard pile displaying a new, recently discarded card.
Figure 4:
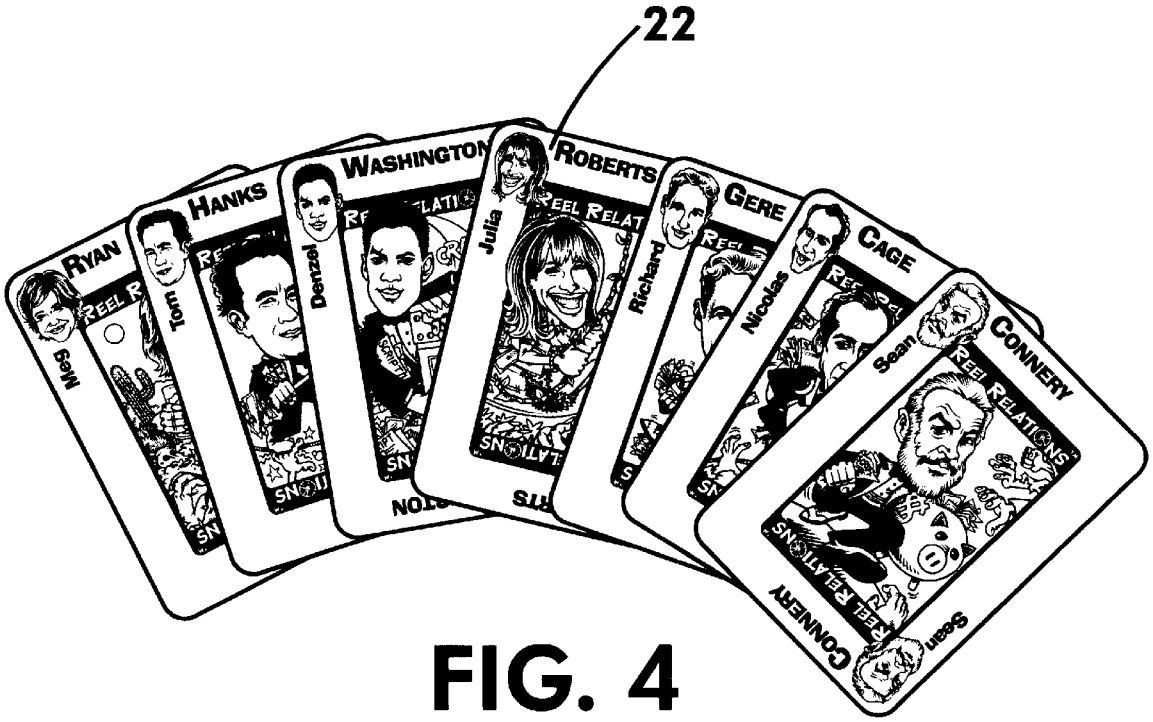
FIG. 4 shows an overview of a completed set of seven cards linking co-stars of motion pictures.
Figure 5:
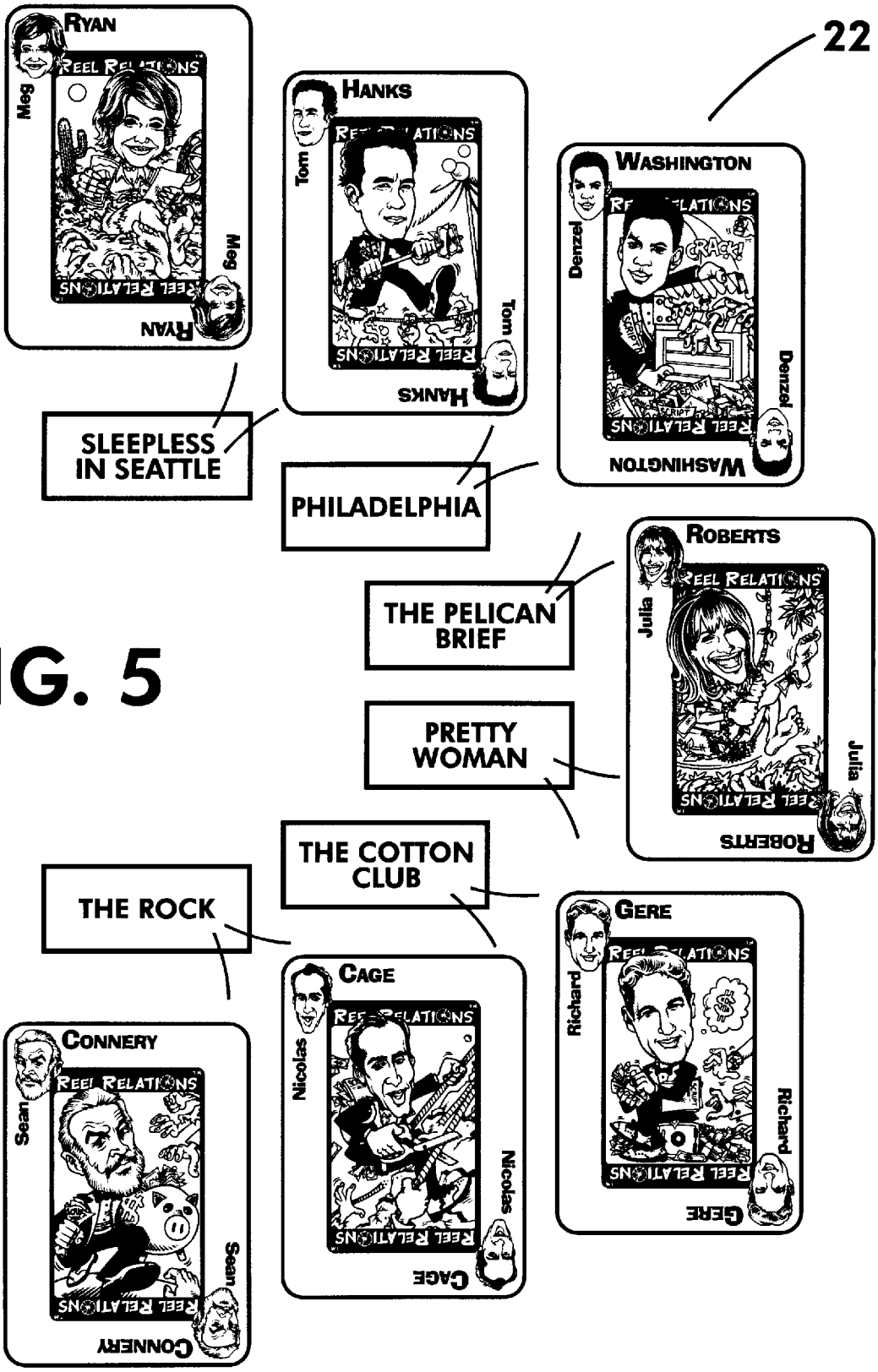
FIG. 5 shows an expanded, view of a completed set of seven cards and further includes a listing of each of the motion pictures that link the co-stars together.

rigid cards 22
jettison section 33
target card 44
draw from section 55
"back" side 66
"face" side 68

DESCRIPTION OF THE PREFERRED EMBODIMENT

Relatively rigid cards 22 are employed and in one preferred embodiment are of rectangular shape having rounded comers for ease in handling and approximately slightly narrower than the standard width of a man's front shirt pocket. Materials used in the construction of traditional playing cards of the type used in gambling casinos in Atlantic City and Las Vegas are acceptable. On back side 66 is printed the logo of the game. On face side 68 is displayed a likeness of a known actor or actress. All game indicia is imprinted onto game card 22 with standard, common printing inks.

The game is started by dealing out preferably seven cards to each player. The game may also be played as a form of solitaire, however, a preferred embodiment incorporating two players will be delineated here. The players among themselves designate who goes first and after having turned over one card from the draw pile 55 so that the newly turned-over card functions as the target card 44 of a discard pile 33, the first player elects to pick-up target card 44 from the newly created discard pile, or may at his or her discretion pick-up a card from draw pile 55. After the first player evaluates the worth of the newly selected card to his or her strategic efforts to create a set, the newly selected card or one of the hand's originally dealt seven cards is discarded face up in discard pile 33. The second player then repeats the process. This process alternating between players taking turns is repeated until one of the players holds a hand of eight cards, seven of which link sequentially one to another through having the images on the cards representing real movie stars who were together in motion pictures. To declare his or her win, the winning player next takes the card that doesn't fit within the set—the extra eighth card—and discards it face down on discard pile 33 saying "Cut! That's a wrap!". Subsequently he or she verbally delineates the names of the motion pictures that the actors and/or actresses acted in together. Male-to-male, female-to-female, star-to-bit-player, as long as the two actors appeared together in the same motion picture a match can be considered qualified.

While the preferred embodiment of the present invention has been described and illustrated it is understood by one skilled in the art that the preferred embodiment is capable of variation, addition, omission and modification without departing from the spirit and scope of the invention.

We claim:

1. A method for playing a game with at least one player comprising the steps of:

providing a plurality of separate sets of game information, each set of game information having an identity of an actor, wherein the identity of an actor of one set of game information and the identity of an actor of any other set of game information are different;

randomizing or mixing said plurality of separate sets of game information;

a player randomly receiving a first set of game information and at least one second set of game information from said mixed plurality of separate sets of game information;

the player attempting to connect said random first set and said at least one random second set of game information via a motion picture in which the actor of said random first set of game information and the actor of said at least one random second set of game information each play at least one role in said motion picture.

2. The method of claim 1 wherein said method comprises the steps of:

(a) providing means to randomize game information sets;

(b) identifying at least one player as the starting player;

(c) establishing a draw-from game information set section from which randomized game information is accessible by said at least one starting player, and wherein the game information of said draw-from game information set section is hidden from view;

(d) establishing a jettison section for rejected sets of game information, wherein at least the most recently jettisoned or said rejected sets of game information sets is visible during game play;

(c) providing said at least one starting player with a pre-determined number of sets of game information accessed from said draw-from game information set section;

(f) permitting, at the start of the game, said at least one starting player to evaluate the pre-determined number of sets of game information available to said at least one starting player, further permitting said at least one starting player to evaluate in order to determine value to game play a first, visible set of game information visible in said jettison section;

(g) permitting said at least one starting player to collect the available set of game information from said jettison section it is determined to be of value, whereupon requiring said at least one starting player to exchange through jettison to said jettison section at least one of said pre-determined member of sets of game information available to said at least one starting player at the start of game play, thereby maintaining the same pre-determined number of sets of game information available to said at least one starting player at the start of the game;

(h) alternatively permitting said at least one starting player to access a set of game information from the draw-from section, if the set of game information visible in said jettison section is determined by said at least one starting player to be valueless;

(i) further permitting the starting player to retain, if it is determined to be of value, a set of game information accessed from said draw-from section, and still further requiring the exchange through jettison to said jettison section of at least one of said pre-determined number or sets of game information available at the start of game play;

(j) alternatively permitting, if the set of game information visible in said jettison section is determined to be valueless, and if a set of game information accessed from the draw-from section is determined to be valueless, the jettisoning of the set of game information accessed from the draw-from section, thereby maintaining in an unaltered state said pre-determined number of sets of game information available at the start of game play;

(k) repeating steps (f–j) until at least one of said at least one players reaches the goal represented by a pre-determined of a number of connected game information sets, at which time said at least one player finally jettisons to the jettison section the extra set of game information that represents one additional set of game information greater than the number of sets of game information pre-determined for play at start of game play;

(l) permitting the winning player to recite at least one connection between said first set of game information and said at least one second set of game information;

(m) permitting the challenging of said at least one connection provided by the winning player;

(n) permitting the game to resume if said at least one connection is determined to be factually incorrect, thereby requiring repeating steps (f–m) until at least one connection between said first set of game information and said at least one second set of game information is determined to be factually correct.

3. The method of claim 1 wherein said method comprises the steps of:

(a) providing means to randomize game information sets;

(b) identifying at least one player as the starting player;

(c) establishing a draw-from game information set section from which randomized game information is accessible by said at least one starting player;

(d) establishing a jettison section for rejected sets of game information;

(e) providing said at least one starting player with a pre-determined number of sets of game information accessed from said draw-from game information set section;

(f) permitting, at the start of the game, said at least one starting player to evaluate the pre-determined number of sets of game information available to said at least one starting player;

(g) permitting said at least one starting player to query a second player as to whether or not the second player has available a set of game information which said at least one starting player believes connects to at least one of the pre-determined number of sets of game information available to said at least one starting player;

(h) requiring the second player to respond truthfully to the query and further, if availability exists, to transfer access to the queried set of information to said at least one starting player;

(i) permitting said at least one starting player to repeat steps (g–h) until the second player responds truthfully in the negative in regard to availability to a queried information set, whereupon said at least one starting player is permitted to access a set of game information from the draw-from section;

(j) permitting a second player to have a turn repeating steps (g–h) until at least one of said at least one players generates a pre-determined number sets of connected game information;

(k) permitting the winning player to recite at least one connection between said pre-determined number of game information sets;

(l) permitting the challenging of said at least one connection provided by the winning player;

(m) permitting the game to resume if said at least one connection is determined to be factually incorrect, thereby requiring repeating steps (g–l) until at least one connection between said pre-determined number of game information sets is determined to be factually correct.

4. The method of claim 1 wherein said method comprises the steps of:

(a) providing means to randomize game information sets;

(b) identifying at least one player as the starting player;

(c) establishing a draw-from game information set section from which randomized game information is accessible by said at least one starting player wherein the game information of said draw-from game information set section is hidden from view;

(d) establishing a jettison section for rejected sets of game information;

(e) providing said at least one starting player with a pre-determined number of sets of game information accessed from said draw-from game information set section;

(f) permitting, at the start of the game, said at least one starting player to evaluate the pre-determined number of sets of game information available to said at least one starting player;

(g) permitting said at least one starting player to jettison to said jettison section a pre-determined number of the sets of game information determined to be of no value, and further permitting said at least one starling player to subsequently access from said draw-from section a number of information sets equal to the number of information sets jettisoned to said jettison section;

(h) repeating steps (a–g) until every one of said at least one players has participated;

(i) permitting each of said at least one players to disclose which information sets have been accessed and connected;

(j) permitting the comparison and challenging or connected information sets wherein the winner is determined by a pre-determined number or type of factually correct connected information sets.

5. The method of claim 1 further including:

in combination, a game of connecting information sets having at least one player and means for determining the factual correctness of connections.

6. A method for playing a game with at least one player comprising the steps of:

providing a plurality of separate sets of game information, each set of game information having an identity of an actor, wherein the identity of an actor of one set of game information and the identity of an actor of any other set of game information are different;

randomizing or mixing said plurality of separate sets of game information;

a player randomly receiving a first set of game information and at least one second set of game information from said mixed plurality of separate sets of game information;

the player attempting to connect the not necessarily connectable said random first set and said at least one random second set of game information via a motion picture in which the actor of said random first set of game information and the actor of said at least one random second set of game information each play at least one role in said motion picture.

7. The method of claim 6 further including:

in combination, a game of connecting information sets having at least one player and means for determining the factual correctness of connections.

* * * * *